United States Patent [19]

Nelson

[11] 4,146,898

[45] Mar. 27, 1979

[54] NON-CONTACT MAGNETIC TONER TRANSFER SYSTEM

[75] Inventor: Alfred M. Nelson, Redondo Beach, Calif.

[73] Assignee: AM International, Inc., Los Angeles, Calif.

[21] Appl. No.: 883,073

[22] Filed: Mar. 3, 1978

Related U.S. Application Data

[63] Continuation of Ser. No. 752,164, Dec. 20, 1976, abandoned, which is a continuation-in-part of Ser. No. 631,329, Nov. 12, 1975, abandoned.

[51] Int. Cl.[2] ..... G03G 19/00

[52] U.S. Cl. ..... 346/74.1; 118/653; 427/14

[58] Field of Search ..... 346/74.1, 153, 154, 346/155; 118/644, 653, 657; 427/14

[56] References Cited

U.S. PATENT DOCUMENTS

| | | | |
|---|---|---|---|
| 2,857,290 | 10/1958 | Bolton | 346/74.1 |
| 2,954,006 | 9/1960 | Lawrence | 346/74.1 |
| 3,292,171 | 12/1966 | Wilson | 346/74.1 |
| 3,400,213 | 9/1968 | Hell | 346/153 |
| 3,735,416 | 5/1973 | Ott | 346/74.1 |
| 3,754,963 | 8/1973 | Chang | 427/14 |
| 3,941,084 | 3/1976 | Kurita | 118/657 |
| 3,956,523 | 5/1976 | Cantarano | 427/14 |
| 4,036,175 | 7/1977 | Phillips | 118/653 |

*Primary Examiner*—Jay P. Lucas

*Attorney, Agent, or Firm*—Ray S. Pyle; Robert S. Hulse

[57] ABSTRACT

Apparatus for printing images on paper or other print medium, including a recording head which records magnetic images on a record tape, means for applying magnetically-attracted toner to the images, transports which hold the record tape and paper a small distance apart to leave an air gap of about 4 thousandths inch between them, a pair of electrodes located so that the toner on the record tape and the paper are sandwiched between the electrodes, and a high voltage source which applies a brief pulse of high voltage of a duration on the order of one millisecond between the electrodes, to form an electric field that propels the toner particles across the air gap from the record tape to the paper.

10 Claims, 13 Drawing Figures

Fig. 4
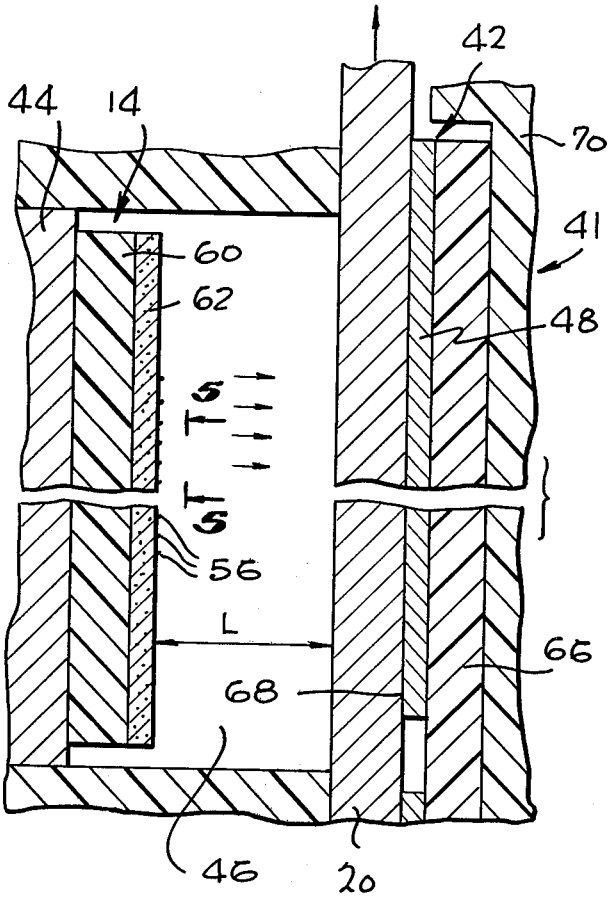
Fig. 5
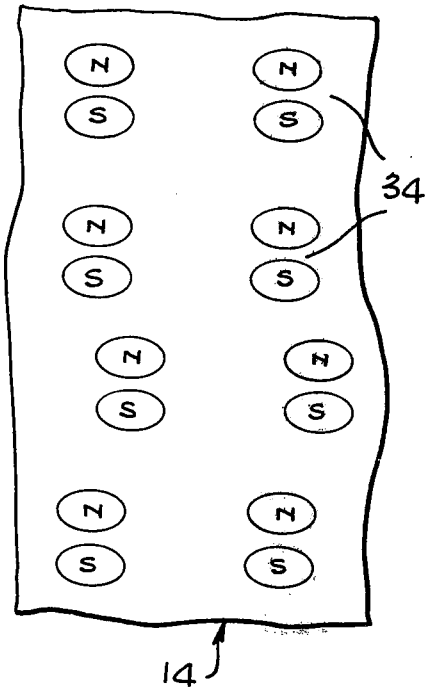
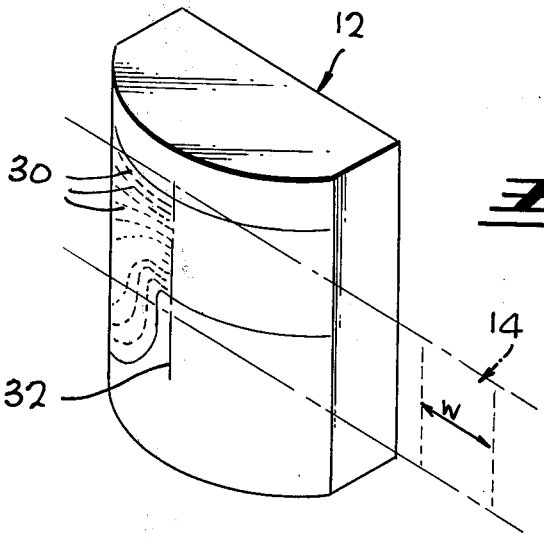
Fig. 6

Fig. 8
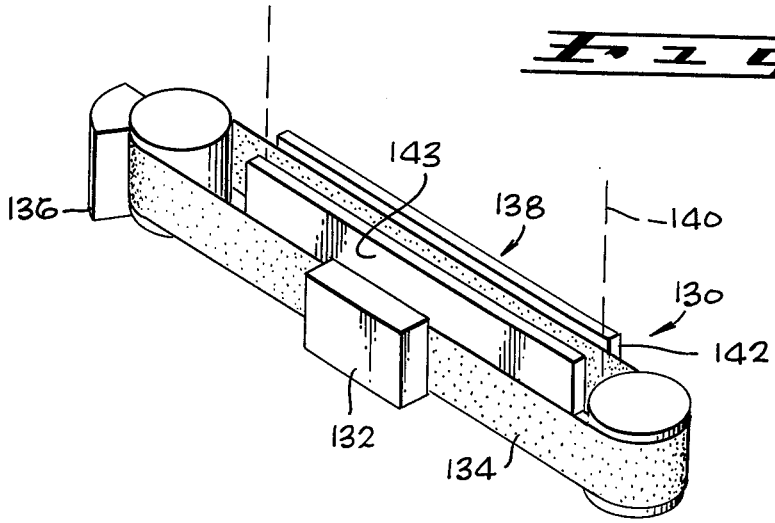
Fig. 9
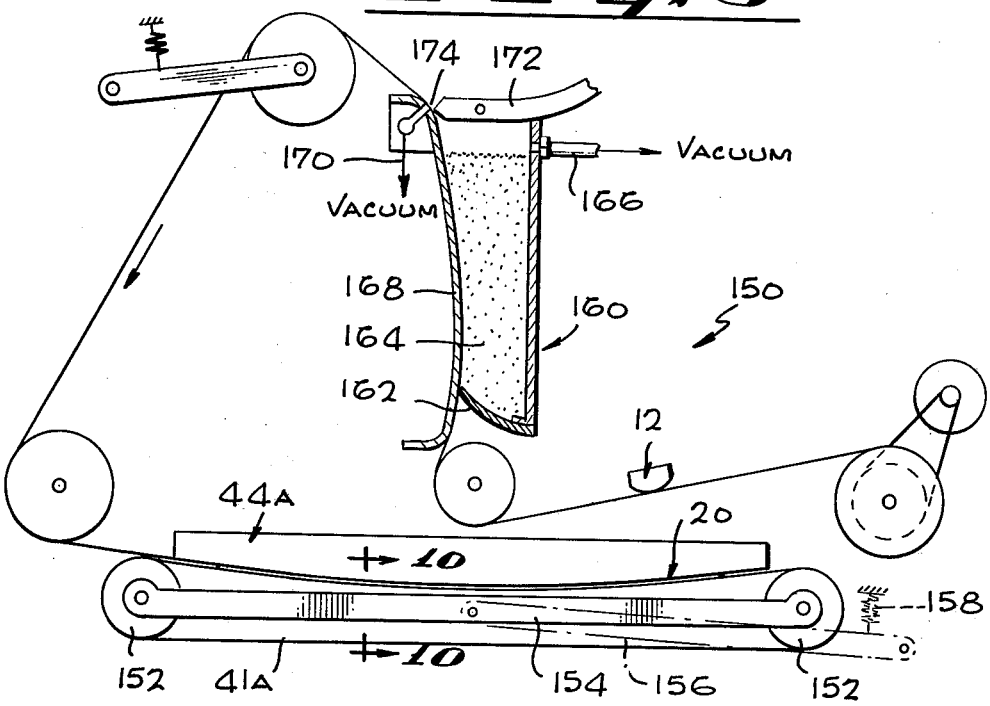
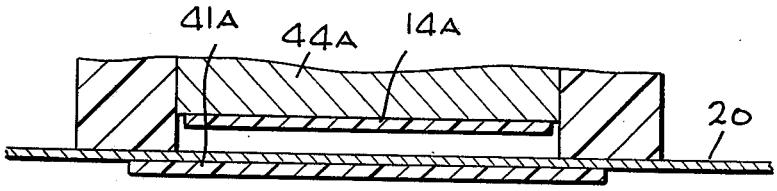
Fig. 10

Fig. 11
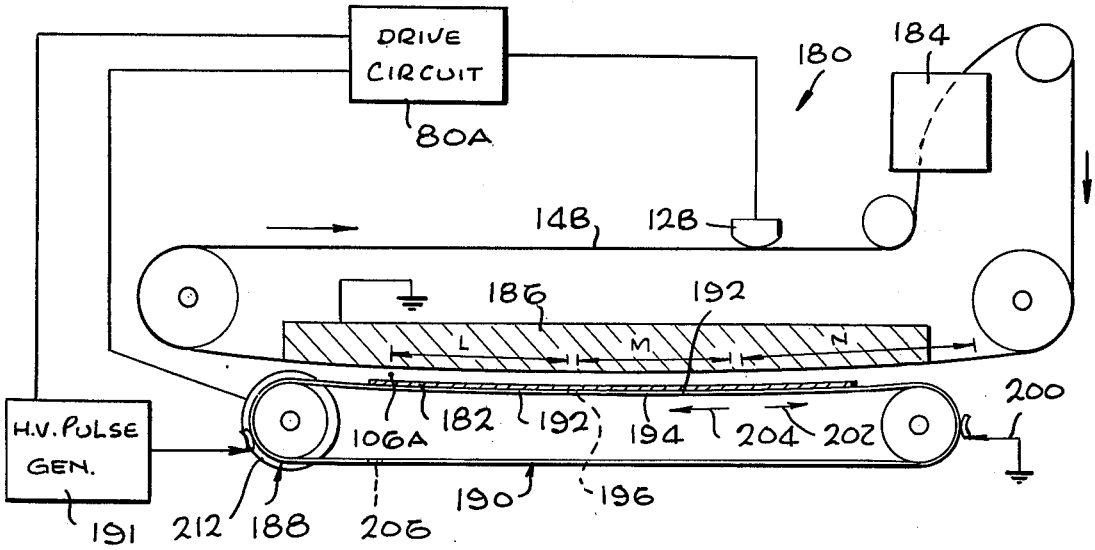
Fig. 12
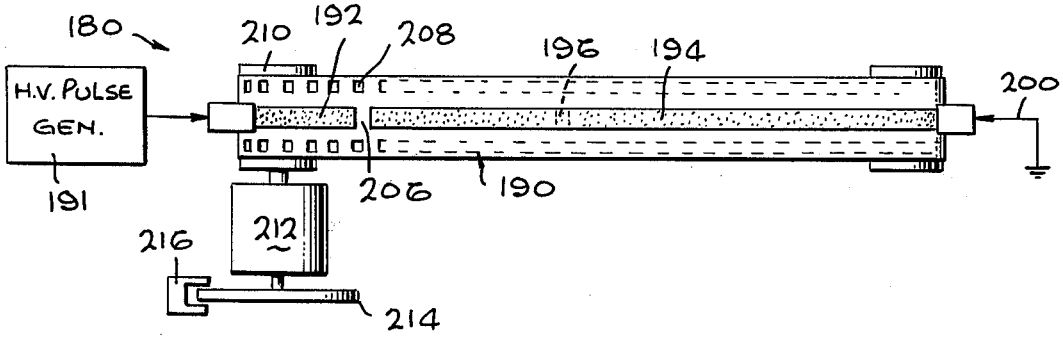
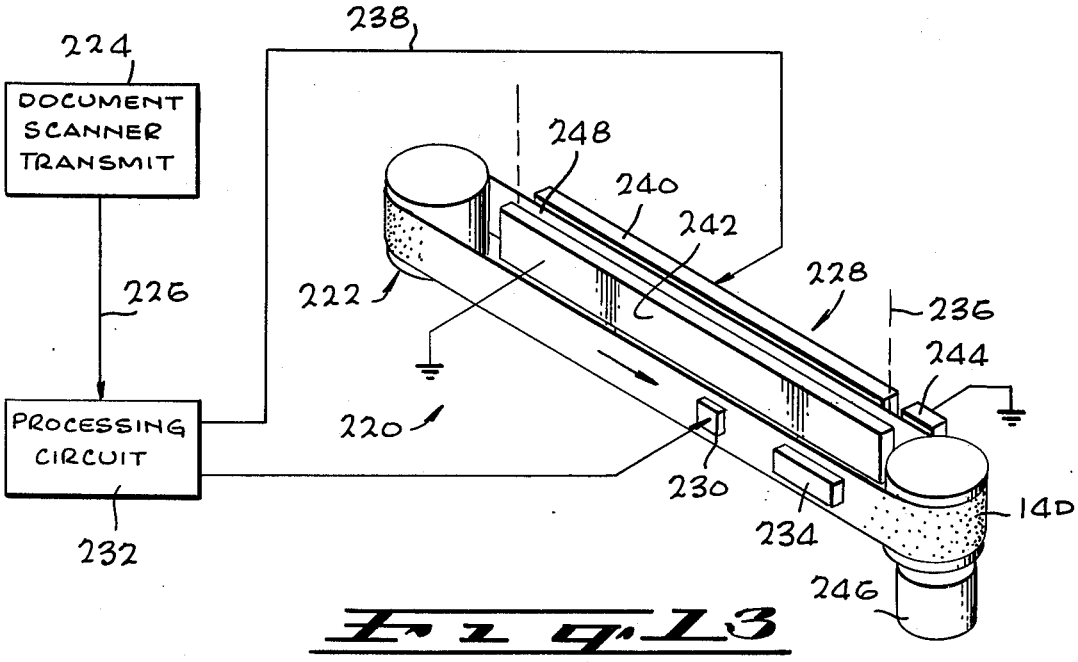
Fig. 13

NON-CONTACT MAGNETIC TONER TRANSFER SYSTEM

REFERENCE TO RELATED APPLICATION

This is a continuation of application Ser. No. 752,164, filed Dec. 20, 1976, now abandoned, which is a continuation-in-part of Ser. No. 631,329, filed Nov. 12, 1975, now abandoned.

BACKGROUND OF THE INVENTION

One technique which can be utilized for printing images on plain paper involves forming an electrostatic or magnetic image on a record medium such as a drum or tape, coating the image with toner, and transferring the toner to a sheet of paper. Where the paper and record move in the same direction at the transfer location, high speed toner transfer can be accomplished by pressing the toner-coated record against the paper. However, where the record moves transverse to the paper, it would be necessary to have both the paper and records stopped for an instant if they are to be pressed together for toner transfer. A less complicated printing apparatus could be constructed if a simple apparatus and method were available to transfer the toner while at least the toner-coated record were moving rapidly across the paper path.

SUMMARY OF THE INVENTION

In accordance with one embodiment of the present invention, a simple printing system is provided which enables the transfer of toner from a toner-coated record to a paper or other print medium in a manner that produces a sharp image and that enables high speed operation in a relatively simple mechanism. The printing apparatus includes guides for holding the record and paper slightly spaced apart along a transfer station to leave a small air gap between them, and a pair of electrodes with one electrode located behind the paper and the other located in front of toner on the record, so that the paper and toner on the record are sandwiched between the electrodes. A voltage supply is coupled to the electrodes to apply a high voltage pulse to the electrodes. The electric field created by the voltage pulse causes the toner to move across the air gap from the record to the paper to thereby transfer the toner. The record can be moved at a relatively high speed across the width of the paper during toner transfer without degrading the transferred image, by utilizing a small and uniform air gap between the record and paper. The image on the record is a magnetic image and the toner particles are magnetically held thereto, so that toner particles substantially free of electrostatic charge can be utilized to prevent mutual repulsion of particles that degrades the image on the paper. The transfer pulse is on the order of magnitude of one millisecond, which has been found to effect good transfer while avoiding blurring of the image even at high record speeds.

The novel features of the invention are set forth with particularity in the appended claims. The invention will best be understood from the following description when read in conjunction with the accompanying drawings.

BRIEF DESCRIPTION OF THE DRAWINGS

FIG. 4 is an enlarged view taken on the line 4—4 of FIG. 2;

FIG. 5 is a view taken on the line 5—5 of FIG. 4;

FIG. 6 is a perspective view of the recording head of FIG. 1;

FIG. 8 is a partial perspective view of a printer system constructed in accordance with another embodiment of the invention;

FIG. 9 is an end view of a printing system constructed in accordance with another embodiment of the invention;

FIG. 10 is a view taken on the line 10—10 of FIG. 9;

FIG. 11 is an end view of a printing system constructed in accordance with another embodiment of the invention;

FIG. 12 is a partial bottom view of the apparatus of FIG. 11; and

FIG. 13 is a perspective view of a facsimile system constructed in accordance with another embodiment of the invention.

DESCRIPTION OF THE PREFERRED EMBODIMENTS

Figure 1:
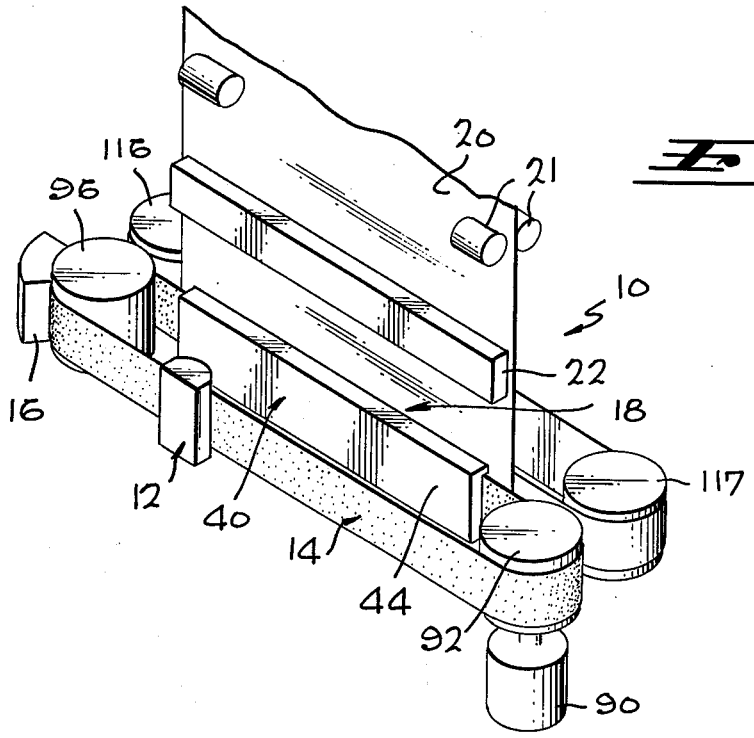
FIG. 1 is a perspective view of a printing system constructed in accordance with one embodiment of the present invention.
Figure 2:
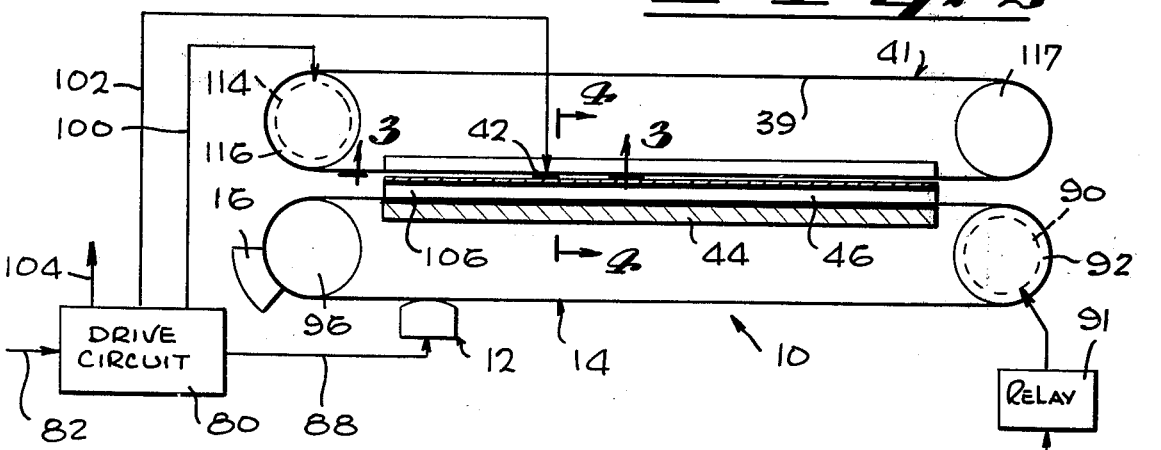
FIG. 2 is a plan view of the system of FIG. 1.

FIGS. 1 and 2 illustrate a printing system 10 which includes a recording head 12 that records magnetic images on a magnetic tape record 14, a toner station 16 that applies magnetically attractable toner particles to the tape record 14 to coat the magnetized areas with toner particles, and a transfer location 18 where the toner particles are transferred to a paper print medium 20. After toner images are transferred to the paper, the paper is advanced by rollers 21 so that the toned areas pass by a fuser 22 that fuses the toner to the paper to form a permanent copy.

The record head 12 is of the type illustrated in FIG. 6, which has a plurality of narrow conductors 30 extending parallel to the path of the magnetic tape 14, with each conductor 30 having a center of conduction that veers close to the tape 14 along a record line 32, so that columns of magnetized spots can be formed on the tape. FIG. 5 shows portions of two columns of magnetized spots on the tape 14, each spot 34 including a north and south magnetic pole to form an individualized magnetic spot on the tape. The spots are formed very close together, such as a few thousandths inch apart, so that they form a magnetic image of an alphanumeric character. Each of the alphanumeric characters can be contained in an area of the tape which has no more than a predetermined character width W (FIG. 6). A more detailed description of the recording head is described in my co-pending patent application, Ser. No. 594,583 filed July 10, 1975.

A toner transfer apparatus 40 (FIG. 2) is located along the transfer location 18 to transfer toner from the tape record 14 to the paper 20 in a relatively simple and effective manner. The toner transfer apparatus includes a first electrode assembly 41 in the form of tape 39 with a transfer electrode 42 thereon, positioned behind the paper 20. The toner transfer apparatus also includes a reference electrode 44 positioned in front of the tape 14, so that the paper 20 and magnetic tape 14 are sandwiched between the electrodes. Along the transfer location 18, the paper 20 and tape 14 are maintained slightly apart to leave a small air gap 46 between them. When a high voltage is applied to the transfer electrode 42, while the reference electrode 44 is maintained at or close to ground potential, a strong electric field is created which tends to draw the toner particles across the air gap 46 against the paper 20. Thus, toner transfer is accomplished in a relative simple manner, without pressing the tape and paper together and without requiring a charged screen or other device in the air gap.

Figure 3:
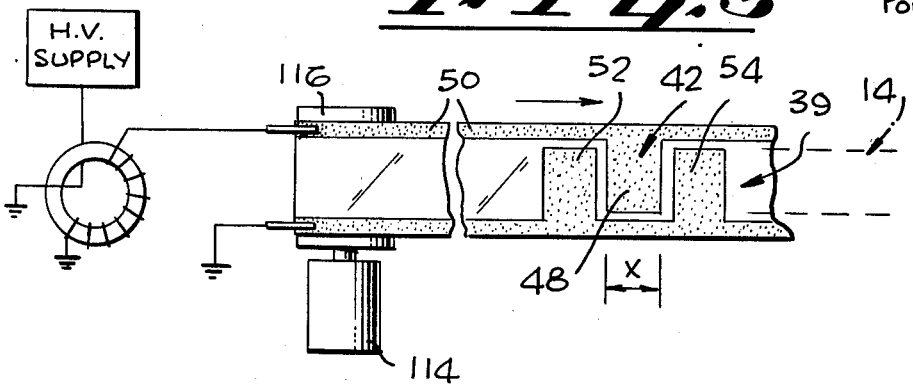
FIG. 3 is a view taken on the line 3—3 of FIG. 2.

The particular transfer electrode 42 utilized in the printing system 10 has the form best shown in FIG. 3, electrode 42 being constructed to transfer only one alphanumeric character at a time to the paper. The transfer electrode 42 includes a transferring portion 48 having a width X approximately equal to the width W (FIG. 6) of a character area on the magnetic tape 14, and also includes a lead portion 50 to facilitate the application of high voltage to the transferring portion. A pair of isolating electrodes 52, 54 are also provided on either side of the transferring electrode portion 48, the isolating electrodes 52, 54 normally being maintained at ground voltage to limit the width of the electric field which is established by the transferring electrode portion 48 when a high voltage is applied to it.

FIG. 4 illustrates the manner in which toner particles 58 on the tape record 14 are transferred to the paper 20 along the transfer location 18. The tape record 14 includes a supporting base 60 of material such as Mylar and a thin layer 62 of magnetizable material such as chromium dioxide of a small thickness such as one quarter mil (¼th of a thousandth of an inch). The electrode assembly 41 comprises a thin layer of electrically conductive material such as copper forming an electrode 42 and supported on a base 66 of insulative materials such as Mylar. When a high voltage is applied to the transfer element or electrode 42, a substantially uniform electric field is established between the transferring electrode portion 48 and reference electrode 44, which causes the toner particles to be attracted to the electrode portion 48 with a force greater than the magnetic force of the magnetizable layer 62 of the tape. The air gap 46 is of a length L of approximately four mil, which is many times greater than the thickness of the magnetic layer 62 of the tape. Accordingly, after the toner particles 56 have travelled a small distance such as one mil across the air gap, the magnetic field of the tape record 14 has very little effect on the particles, and therefore substantial sideward deflection of the toner particles by magnetic fields is avoided as the particles fly across the air gap to the paper.

In order to maintain the small air gap 46, the tape record 14, paper 20, and electrode assembly 41 are accurately guided along their paths. The tape record 14 is backed by the grounded reference electrode 44 and is held under tension, to keep it pressed against the electrode 44. The electrode assembly 41 is similarly backed by a guide 70, and the paper 20 is maintained under tension to keep it pressed against the electrode assembly 41. Transfer is accomplished by applying a brief high voltage pulse such as 1,500 volts to the first electrode 42. The pulse has a duration such as one millisecond during which it is above substantially zero or a low level such as 500 volts which is one-third the maximum voltage.

The tape record 14 is preferably constructed of a magnetizeable material such as chromium dioxide, and the image thereon is preferably a magnetic image toned by magnetically attracted toner. If the particles were, instead, held on an electrostatically-charged record, wherein the particles could pick up an electrostatic charge, then the image on the paper would become blurred. This is because charged particles repel each other. Even where magnetic images are used, care must be taken to assure that the magnetically attractable particles do not pick up electrostatic charges in the toner applying device. It has been found that where such particles pick up a charge, the image becomes considerably blurred. This appears to be due to the particles spreading apart during transfer across the air gap because of mutual repulsion of particles having charges of the same polarity.

It may be noted that the use of a magnetic field to initially hold the particles on the tape record 14, and the use of a different type of field (electrostatic) to transfer the particles from the tape record to the paper, can avoid interactions of the fields and thereby prevent erasure of the images on the tape. For example, if the tape had electrostatic images, the electric field used to transfer the toner would erase the images on the tape. The use of a magnetic image on the tape, which avoids image erasure, is useful in permitting the tape to be used for making a second copy, which can be accomplished by merely reapplying toner to the tape and moving it past another paper area at the same or another transfer location.

The thickness of the air gap at the transfer station has been found to greatly affect the quality of the image produced on the paper. The optimum air gap thickness has been found to be about 4 mil. With air gaps of less than about 4 mil, random transfer of toner has been found to often occur, which produces background on the paper, although the toner that is transferred by the transfer pulse produces a clear image. For example, in one series of tests using a 3 mil gap, about half the toner was drawn off at the edge of the paper in some tests. It is believed that the random toner transfer for gaps of less than about 4 mil is due to induced fields resulting from the dielectric tape moving between the two closely spaced electrodes. When air gaps of more than 4 mil are used, the printed characters become progressively more blurred as progressively larger air gaps are used. A noticeable degradation of image occurs even at a 5 mil air gap, and the image quality becomes very noticeably blurred and unacceptable in many applications when air gaps of more than about 8 mil are utilized. Thus, the distance between the paper and the tape should be maintained substantially constant at all toned regions of the tape, and with a substantially uniform air gap which is preferably of about 4 mil thickness, to avoid blurring of portions of the image.

The duration of the transfer pulse is preferably between 0.25 millisecond and 4 milliseconds. For a 4 mil gap, it was found that when a pulse of about 0.1 millisecond was applied, less than 50% of the toner was transferred across the air gap from the tape to the paper for typical bond paper. With a 0.25 millisecond pulse, about half the toner was transferred, and with a 2 millisecond pulse virtually all toner was transferred. With a pulse much more than 2 milliseconds, such as above 4 milliseconds, the transferred toner began to spread apart on the paper, which made the characters become fuzzy. With electrographic paper, (which yields sharper images) a pulse length of about 1 millisecond was found to be optimum, while with typical bond paper a pulse length of about 2 milliseconds was found to be optimum (for air gaps between 4 and 8 mil). Thus, a pulse duration on the order of magnitude of 1 millisecond is preferred, as it produces substantially complete toner transfer and minimal spreading apart of the particles. It also has been found that the rise time of the pulse is not critical, as pulses with a rise time of 0.5 milliseconds have been found satisfactory, and it has been found that there is no difference in image quality or background for rise times varying between 0.1 and 0.5 milliseconds.

It might be supposed that the rise time or duration of the transfer pulse must be very short to avoid blurring of the characters. However, this has been found not to be the case. For example, with a tape moving at a speed of 50 inches per second, and a transfer pulse with a rise time of 0.50 milliseconds, the tape travels 25 mils (thousandths inch) during the rise time. For typewritten characters that are typically arranged ten to the inch and with each character about one-sixteenth inch wide (62.5 mil), a blurring of 25 mils would not only be very noticeable but would make the printing unacceptable in most applications. However, it is found that no such large blurring occurs. It may be noted that spreading apart of particles after they have been transferred to the paper, can be avoided by applying a moderate voltage such as 150 volts between the electrodes after the transfer pulse.

The toner transfer technique of the invention permits the construction of the printing system 10 as an asynchronous printer, which receives signals representing alphanumeric characters at irregular intervals, but which prints the characters at uniform spacings on the paper 20 or other print medium. As illustrated in FIG. 2, the apparatus is energized by a drive circuit 80 which receives information signals on a line 82 that represent characters to be printed. The circuit 80 has an output line 88 connected to the recording head 12 to drive it so as to record characters on the tape record 14. The line 88 includes a cable with thirty-two lines which energize thirty-two separate record elements to form a column of up to thirty-two spots of magnetization on the tape. As the tape record 14 moves past the recording head, repeated pulses are delivered over the line 88 to record successive columns of magnetic spots on the tape, a series of up to thirty-two columns forming the complete character. The tape is driven by a motor 90 at a constant speed such as fifty inches per second. The motor 90, which is energized through a relay 91 from a power line, turns a roller 92 that advances the tape along a loop formed by roller 92 and another roller 96.

The drive circuit 80 also includes an output line 100 that is connected to a stepping motor 114 that moves a transfer tape 88 which holds the electrode assembly 41. The stepping motor 114 is connected to a roll 116 that holds the transfer tape 33 as a loop that extends about another roll 117. The motor 114 can turn the roll 116 by a precise amount to cause the transfer electrode 42 to advance to a known column position along the paper to transfer toner to that location along the paper. The drive circuit includes another output line 102 which is connected to the transfer electrode 42 to deliver a brief high voltage pulse that causes toner transfer from the tape to the paper, in the manner described above. Another output line 104 of the drive circuit is connected to a motor (not shown) that is connected to the paper-advancing rollers 21 to advance the paper so that another line of characters can be printed thereon. Each line of characters is normally printed within a printable region along the width of the paper, between a left margin, or initial column position 106, and a right margin.

Figure 7:
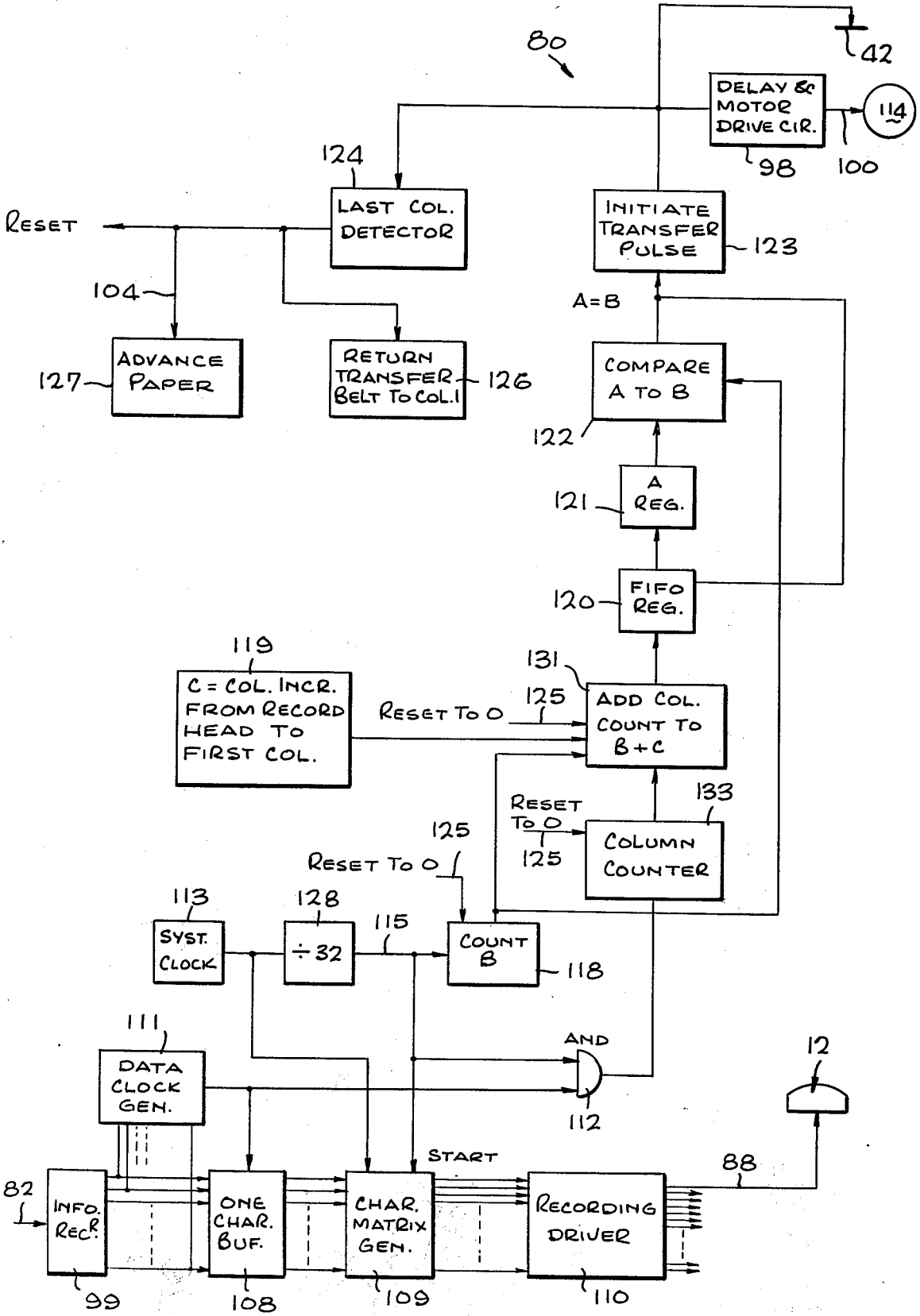
FIG. 7 is a block diagram of the drive circuit of FIG. 2.

FIG. 7 is a block diagram of the drive circuit 80 which drives the record and transfer heads 12, 14 as well as the stepping motor 114 and a motor that advances the paper. Data or information signals are received over the line 82 by an information receiver 99 whose output typically includes six to eight conductors that receive binary signals representing sixty-two to two hundred fifty six characters or commands. The signals are delivered to a one character buffer 108 which stores the character and delivers it to a character matrix generator 109. The generator 109 has thirty-two output conductors connected to a recording driver 110 which supplies current pulses of sufficient intensity to thirty-two conductors of line 88 to drive the corresponding recording conductor elements of the recording head 12.

The drive circuit 80 also includes a data clock generator 111 which generates clock signals when data is being received on line 82. The output of generator 111 is delivered to the buffer 108 to cause it to deliver its character to generator 109, and is also delivered to an AND gate 112. The drive circuit includes a system clock 113 whose output is delivered to the character matrix generator 109 to synchronize it with the rest of the circuit. The output of clock 113 is divided by thirty-two in a divider 128 to provide an output at 115 which represents the beginning of successive increments of tape movement equal to one column increment on the printed page. The output at 115 is delivered to the AND gate 112. The AND gate 112 delivers a pulse to a column counter 133 for each character of data which has been received. An adding circuit 131 receives the count in the column counter 133, which represents the number of characters which have thus far been recorded on the magnetic tape since the paper was advanced by one line. The adder at 131 also receives the count B in another counter 118 which represents the distance (in number of character widths) that the magnetic tape has moved since the paper was advanced. The adder 131 further receives a constant held in a generator 119, which represents the distance, in number character widths, between the record head 12 and the initial transfer column 106 along the paper. The adder 131 adds the counts received from the three circuits 133, 118, and 119, and delivers the sum to a FIFO register 120.

The FIFO register 120 delivers one count at a time to an "A" register 121. The count in register 121 is delivered to a comparing circuit 122, which compares the count "A" in register 121 with the count "B" in register 118. When the counts "A" and "B" are equal, the compare circuit 122 delivers a pulse to an initiating circuit 123. The initiating circuit 123 then delivers a high voltage pulse over line 102 to the first transfer element 42 to cause the transfer of toner to the paper. The pulse from the compare circuit is also delivered to FIFO register 120 to cause the next address to be delivered to the "A" register 121.

The pulse over line 102, which causes transfer of toner, also is delivered to a delay and motor device circuit 98 whose output 100 is delivered to the stopping motor 114 to advance the transfer electrode. The pulse over line 102 is further delivered to a last column detecting circuit 124. When a character is printed at the last column position on the paper near the right margin of the paper (or when an "end of the line" command follows a character), the detector 124 delivers a pulse over line 125 which resets the circuits 133, 131, and 118. The pulse on line 125 is also delivered to a return circuit 126 that operates the stepping motor 114 to return the transfer belt with the electrode assembly 41 thereon to the first column position near the left margin of the paper. The pulse on line 125 is also delivered over line 104 to an advance paper drive 127 that causes the paper to be advanced by a distance of one line, so that the next line of characters can be printed on the paper.

Thus, the asynchronis printing system 10 can receive information representing characters, at irregular intervals, and yet can print the characters in an evenly spaced arrangement along a line of the paper. The asynchronis printer utilizes the fact that the record tape 14 moves perpendicular to the direction of movement of the paper 20 to enable the printing of individual characters along a line extending across the paper. This is made possible by the fact that the tape record 14 does not have to contact the paper 20, and by the fact that the electrode structure localizes the transfer field to transfer toner at only one selected column position.

FIG. 8 illustrates another printing system 130 in the form of a line printer. The line printer 130 includes a printing head 132 which forms magnetic images on a tape record or tape 134, a toner station 136 that tones the images, and a transfer station 138 where the toner is applied to a paper web 140. The apparatus is similar in many ways to the asynchronis printer system 10 of FIGS. 1 and 2, except that it utilizes a transfer electrode 142 which extends across most of the width of the paper 140 and which is stationary. A grounded reference electrode 143 similar to electrode 44 is positioned in front of the tape 134. In the system 130, an entire line of magnetic characters is recorded so that the characters are uniformly spaced along the length of the tape 134. After the toned line of characters has been moved opposite the paper 140, a voltage pulse is applied to the wide electrode 142 to simultaneously transfer the entire line of characters to the paper. A similar apparatus can be utilized to make a copy of a document, by utilizing apparatus of the type described in my U.S. Pat. No. 3,987,491, to form a magnetic image on the record which represents the image on a document to be copied.

FIGS. 9 and 10 illustrate a printing system 150 constructed in accordance with another embodiment of the invention, wherein a grounded reference electrode 44A which supports the portion of the magnetic tape opposite the paper, is convexly curved so as to accurately position the tape. The electrode arrangement 41A is on a tape that extends about a pair of rollers 152 that are held on a bracket 154 that is biased against the tape 14A. The biasing is accomplished by a supporting link 156 that is upwardly biased by a spring 158. After the magnetic tape 14A passes by the record head 12, it enters a toning apparatus 160 which includes a resilient brush 162 that holds in the toner 164 while permitting the upward passage of the tape 14A past the toner. The top of the toner container is left unoccupied, and is evacuated to a tube 166 that is connected to a vacuum source. The tape passes about a curved backing 168, to help prevent toner from coating the back face of the tape. As the tape leaves the chamber, another tube 170 which is coupled to a vacuum, tends to draw off any toner which has stuck to the back surface of the tape. The vacuum applied to the top of the container through tube 166, tends to draw off excess toner. A cover 172 tends to regulate the size of the opening at 174 out of which the tape passes.

FIGS. 11 and 12 illustrate still another printing system 180 which can receive synchronous data representing lines of characters to print them on a sheet or web of paper, 182 wherein little or no pause in the data transmission is required between lines of data. Such pauses between lines of data have been provided to allow time for a printing carriage to return from the end of one line to the initial or first column position, and/or to allow time to advance the paper to begin printing another line. Where the data contains many short lines of characters, a high proportion of transmission time may be occupied by such pauses. Where the data is transmitted, as over long distance telephone lines, where the transmission cost depends upon the length of time during which the transmission occurs, the added time may considerably increase the cost of transmission.

In the system of FIGS. 11 and 12, each of the lines of data are recorded in sequence on the magnetic tape 14B, with little or no gap between successive lines of data. Thus, one line of data extends along the tape portion L, a next line extends along the portion M, a next line extends along the portion N, etc., with the only gap between these tape portions being the normal one-character gap between different words. The data is recorded on the tape by a head 12B, the recording is toned in a toning device 184, and the toned images on the magnetic tape are passed over a backing or reference electrode 186 that is electrically grounded.

The toner transfer apparatus 188 is constructed so that it can transfer each line of data, such as the line lying along the magnetic tape portion L, without causing the transferrence of toner from the next adjacent line of data which lies along the adjacent tape portion M. To accomplish this, the transfer apparatus includes a tape 190 with two electrodes 192, 194 separated by a gap 196. When the line of characters L to be transferred lies in the position shown in FIG. 11, with its leading end opposite the first column position 106A on the paper, a high voltage pulse is delivered from a pulse generator 191 to the transfer electrode 192. This causes the toner on the magnetic tape 14B to be transferred to the paper sheet 182 to transfer the toner on that tape portion L. The isolating electrode 194 is connected through a brush a conductor 200 to ground, so that none of the toner on the next line of characters to be printed on tape portion M, will be attracted across the air gap to the paper 182.

After a first line of characters L has been printed, the transfer tape 190 is moved to a position wherein the gap 196 will lie at the rearward or trailing end of the next line of characters to be printed, from tape portion M, when the leading end of tape portion M reaches the initial column position. This next location of the gap 196 is determined by a circuit which counts the number of characters recorded for the next line, on tape portion M. At the same time as the transfer tape is moved, the paper is advanced by one line. The magnetic tape 14B is, as is in the previous printer system, moved at a constant speed along its path. When the leading edge of the line of characters M reaches a position opposite the initial column position 106A, another pulse is delivered from the pulse generator 191, to effect transfer of the next line of characters, along tape portion M, to the paper. A drive circuit 80A using the same techniques of synchronization as the circuit 80, is utilized to drive the apparatus.

Thus, each line of characters to be printed, can be recorded by recording head 12B on the magnetic tape, without a large gap between successive lines of characters, to thereby minimize the transmission time. This is accomplished without normally requiring especially high acceleration or speed of the transfer tape 190. In a situation where a very short line, consisting of one or a few characters, is to be followed by a long line, it is desirable to provide extra spaces at the end of the short line to avoid the need for high acceleration and speed of the transfer tape.

As shown in FIG. 12, the transfer tape 190 includes a second gap 206 to separate the two electrodes 192, 194 at their ends which lie opposite the first gap 196. The transfer tape 190 is provided with sprocket holes 208 for engagement by a sprocket wheel 210 to accurately control the position of the tape. A motor 212 which drives the sprocket wheel and transfer tape, has a double ended shaft, with one end of the shaft having an optical encoding disc 214 that can be sensed by a sensor 216 to accurately control the position of the transfer tape.

FIG. 13 illustrates a facsimile system 220 which utilizes the recording and toner transfer method of the invention to enable the use of a simple recorder or receiver 222. A document scanner and transmitter 224 of the prior art, scans a document one line at a time, and transmits signals over a telephone line 228 representing the darkness at points sequentially spaced along a scan line. The transmitter 224 also transmits a beginning-of-line signal at the beginning of each scan line, before scanning the line and transmitting signals representing the darkness of points therealong. Typically, a scanner scans at a density of one hundred lines per inch, and scans an entire page in six minutes. In prior art systems, the facsimile receiver utilized a recorder that had to be synchronized with the scanner. This required an initial period, before the transmission of document-scanning signals, during which only synchronizing signals were transmitted, and during which the recording phase of the facsimile receiver was shifted to synchronize it with the scanner. The construction of the receiver to permit synchronizing complicated the receiver.

In the apparatus of FIG. 13, the facsimile receiver 222 includes a printing mechanism 228 similar to the line printer of FIG. 8, but with only one record element on a record head 230. As signals from the telephone line 226 are received by a processing circuit 232, corresponding signals are recorded by the head 230 on a magnetic tape record 14D. The magnetic tape 14D moves at a constant speed past a toner station 234 and across the width of paper 236. Each time a portion of tape 14D containing one scan line, reaches a position opposite the paper 236, a high voltage transfer pulse is delivered by the processing circuit 232 over line 238 to an elongated transfer electrode 240 that lies behind the paper. The pulse to electrode 240 causes toner representing one scan line to be transferred to the paper. A grounded backing electrode 242 lies beside the magnetic tape, and a grounded isolating electrode 244 lies near one end of the transfer electrode.

The magnetic tape 14D is moved at a constant speed by a motor 246 without synchronism being required between the position of the scan head of the document scanner 224 and the position of the magnetic tape. In order to assure that each scan line is printed in the proper position on the paper, the processing circuit 232 is constructed to sense the beginning-of-line signal received from the scanner 224 and after a delay period, to deliver a transfer pulse to transfer electrode 240. For example, if the magnetic tape 14D moves at a speed of 24 inches per second, and if the distance along the path of tape 14D between the record head 230 and the initial column position 248 is 12 inches, then the transfer pulse delivered over conductor 238 to transfer one scan line, occurs one-half second, or 500 milliseconds, after the beginning-of-line signal received from the scanner 224. The motor which drives the scanner 224, and the tape moving motor 246, must move at the same speed, but this is easily accomplished by using synchronous motors connected to the power line, or by other relatively simple arrangements. The facsimile receiver 222 therefore does not have to be synchronized with the scanner, and a simple facsimile receiver can be constructed which can print images on plain paper.

Thus, the invention provides a toner transfer and printer apparatus, wherein toner on a record is transferred to a web of paper or other print medium through an air gap by the application of an electric field across the air gap that propels the toner particles. A high voltage pulse of a duration on the order of magnitude of one millisecond is applied to an electrode behind the print medium to generate a brief electric field. The electric field causes toner transfer to produce a relatively sharp image on the print medium, even while the record is moving rapidly across the print medium. The record which temporarily holds the toner particles in the desired image, preferably includes a thin layer of magnetizable material with magnetized spots that form the image. The air gap is uniformly small all over the area where toner is to be transferred, and is preferably less than ten mil (thousandth inch) in thickness. The toner particles are preferably held by magnetic fields on the record, which avoids interaction of the magnetic image-forming field on the record with the electric transference field. A variety of printing devices can be constructed, including an asynchronis character printer of simple construction, a simple line printer that requires little or no gap in transmission between successive lines, and a facsimile receiver of simple construction that prints on ordinary paper.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. A printing system comprising:

a record having a layer of magnetizable material therein;

a magnetic recording head for magnetizing said record to form magnetic images thereon;

a toning device containing magnetically attractable toner, for toning magnetic images on said record;

a print medium transport for moving a print medium past a predetermined transfer location;

a record transport for moving said record past said head and said toning device, and adjacent to a print medium at said transfer location;

means defining a pair of electrodes, one of which extends along said transfer location behind the toner on the record and the other behind the print medium portion which extends along said transfer station;

said electrode behind the toner on the record being a fixed guide for holding said record close to and slightly spaced from said print medium to provide an air gap of a predetermined uniform width between them; and means for applying a voltage between said electrodes, to cause the toner on said record to move across said air gap from said record to said print medium.

2. The printing system described in claim 1 wherein: said means for applying a voltage applies a transfer voltage pulse of a duration on the order of magnitude of one millisecond.

3. The printing system described in claim 1 wherein: said means for holding said record and print medium apart, holds them at a separation of no more than eight thousandths inch apart at substantially all regions of said record which lie opposite the print medium.

4. In a printing system which includes a record transport for moving a record containing toner that forms images thereon, along a predetermined record path, a print medium transport for moving paper or other print medium along a predetermined print medium path that passes adjacent to said record path, and a transfer location at the region where said print medium path moves adjacent to said record path, the improvement comprising:

a transfer apparatus located along said transfer location, including a first electrode means located on a side of toner on said record opposite said print medium path, and a transfer electrode located on a side of said print medium path which is opposite said record;

said first electrode being a fixed guide for holding said record close to and slightly spaced from said print medium path to provide an air gap of a predetermined uniform width between them; and means for applying a voltage pulse between said electrodes of more than a few hundred volts, to cause the toner on said record to move across said air gap from said record to said print medium;

said means constructed to apply a pulse having a duration on the order of magnitude of one millisecond.

5. The improvement described in claim 4 wherein: said duration is between one-quarter millisecond and four millisecond.

6. The improvement described in claim 4 wherein: said air gap is between about four and eight thousandths inch thick.

7. In a printing system which includes a record transport for moving a record containing toner that forms images thereon, along a predetermined record path, a print medium transport for moving paper or other print medium along a predetermined print medium path that passes adjacent to said record path, and a transfer location at the region where said print medium path moves adjacent to said record path, the improvement comprising:

a transfer apparatus located along said transfer location, including a first electrode means located on a side of toner on said record opposite said print medium path, and a transfer electrode located on a side of said print medium path which is opposite said record;

said first electrode means including a fixed guide body for holding said record and print medium slightly spaced apart at said transfer location, to leave an air gap of a predetermined uniform width between them; and means for applying a voltage between said electrodes, to cause the toner on said record to move across said air gap from said record to said print medium;

said gap being less than eight thousandths inch thick.

8. Printing apparatus comprising:

a record;

means for forming a magnetic image on said record;

means for applying toner to the image area of said record;

means for moving a print medium along a print medium path;

means for moving said record across said print medium path;

combined electrode and guide means for holding said record and a print medium which extends along said medium path, so that they are spaced to leave a small gap of a predetermined uniform width between them; and means for applying an electric field from said electrode and guide means across said gap that moves toner from said record to the print medium.

9. In a printing system which includes a record transport for moving a record containing toner that forms images thereon, along a predetermined record path, a print medium transport for moving paper or other print medium along a predetermined print medium path that passes adjacent to said record path, and a transfer location at the region where said print medium path moves adjacent to said record path, the improvement comprising:

a transfer apparatus located along said transfer location, including a reference electrode located on a first side of said record opposite said print medium path, and a transfer electrode located on a second side of said print medium path which is opposite said record;

said reference electrode being a rigid body for holding said record and print medium slightly spaced apart at said transfer location, to leave an air gap of a predetermined uniform width between them; and means for applying a voltage between said electrodes, to cause the toner on said record to move across said air gap from said record to said print medium;

said transfer apparatus including a pair of isolating electrode portions positioned on opposite sides of transfer electrode in a direction parallel to the length of said record path; and said means for applying a voltage including means for applying approximately the potential of said reference electrode to said isolating electrode portions.

10. An asynchronis printer comprising:

a record web containing a layer of magentizable material;

a record web transport for moving said record web along a predetermined record web path at a predetermined uniform speed;

a print medium transport for moving a print medium along a predetermined print medium path which extends across said record web path at a predetermined transfer station, said transfer station including a plurality of character locations uniformally spaced by a predetermined character spacing distance along said record web path;

magnetic image recording means disposed along said record web path, for recording magnetic character images on said record web, with each character image normally lying within a predetermined rectangular image area of predetermined limited width on said record web;

means for applying magentically attractabble toner to said record web, to coat images thereon;

transfer apparatus located at said transfer station for forming an electric field that urges toner to move from said record web to said print medium, including a rigid transfer electrode located on a side of said print medium path opposite said record web for holding record web and print medium spaced apart a predetermined uniform width, and a transfer motor for moving said transfer electrode along a predetermined transfer electrode path portion parallel to said record web path, so that said transfer electrode can be positioned at a selected location opposite said record web;

an information receiver for receiving signals representing characters; and a circuit having a first means (110) coupled to said information receiver and to said magnetic image recording means for operating said recording means substantially immediately after each character-representing signal is received by said information receiver to form a magnetic image on said record web, second means (100) for operating said transfer motor to advance said transfer element by said character spacing distance, and third means (102) for operating said transfer apparatus a predetermined time after said first means records an image, to transfer toner from said record web to said print medium, said predetermined time being equal to a first period required for a record web location to move from said recording means to a first character position (106) on said print medium path plus a second period required for a record web location to move a distance equal to the number of character locations already formed on a line, whereby transfer of toner representing the next character occurs at substantially the same time as a corresponding image on said record web arrives at the next character location.

* * * * *